US009475614B2

(12) United States Patent
Rittenour

(10) Patent No.: US 9,475,614 B2
(45) Date of Patent: Oct. 25, 2016

(54) MATERIAL COLLECTION APPARATUS

(76) Inventor: Mari Rittenour, Portland, OR (US)

( * ) Notice: Subject to any disclaimer, the term of this patent is extended or adjusted under 35 U.S.C. 154(b) by 0 days.

(21) Appl. No.: 13/301,153

(22) Filed: Nov. 21, 2011

(65) Prior Publication Data

US 2012/0128269 A1 May 24, 2012

Related U.S. Application Data

(60) Provisional application No. 61/415,742, filed on Nov. 19, 2010.

(51) Int. Cl.

| | |
|---|---|
| ***B65D 30/00*** | (2006.01) |
| ***A45C 3/00*** | (2006.01) |
| ***A45C 7/00*** | (2006.01) |
| ***A45C 13/00*** | (2006.01) |
| *A45C 11/00* | (2006.01) |

(52) U.S. Cl.

CPC ..... *B65D 29/00* (2013.01); *A45C 3/001* (2013.01); *A45C 7/0077* (2013.01); *A45C 13/008* (2013.01); *A45C 11/00* (2013.01); *A45C 2007/0013* (2013.01)

(58) Field of Classification Search

CPC ..... A01G 1/12; A01G 9/04; B65D 75/14; B65F 1/00; Y10T 428/24005

USPC ..... 383/4, 6, 7, 36; 141/331, 337; 280/18–20; 294/137, 140–142, 149, 294/150, 152; 5/625, 627, 628

See application file for complete search history.

(56) References Cited

U.S. PATENT DOCUMENTS

| | | | | |
|---|---|---|---|---|
| 3,747,653 A * | 7/1973 | Ringer | B65B 67/1238 15/257.1 | |
| 4,434,829 A | 3/1984 | Barnard | | |
| 4,500,129 A | 2/1985 | Hahn | | |
| 4,561,480 A | 12/1985 | Underwood et al. | | |
| 4,580,372 A | 4/1986 | Osborn | | |
| 4,602,664 A | 7/1986 | Hullen | | |
| 4,620,396 A | 11/1986 | Bjorntwedt | | |
| 4,693,504 A | 9/1987 | Baker | | |
| 4,938,607 A | 7/1990 | Kelley | | |
| 4,967,986 A * | 11/1990 | Schildkraut | 224/250 | |
| 5,020,184 A | 6/1991 | Roberts | | |

(Continued)

OTHER PUBLICATIONS

Pascua, Jes F. "International Preliminary Report on Patentability", in connection with corresponding PCT Patent App. Serial No. PCT/US2011/61669, Nov. 2, 2012, 17 pages.

(Continued)

*Primary Examiner* — Jes F Pascua

(74) *Attorney, Agent, or Firm* — Kolisch Hartwell, P.C.

(57) ABSTRACT

An apparatus for collecting material is provided. The apparatus may include a flexible support structure having a first surface and a second surface, the first surface including a material collection area. The apparatus may further include a closure system including a first fastener member disposed on the first surface and a second fastener member disposed on the second surface. At least a portion of the closure system may be spaced from a peripheral edge of the support structure and/or may be configured to releaseably join the first surface and the second surface together. The support structure may include an open configuration and a rolled configuration, wherein in the rolled configuration the closure system may releaseably join the first surface and the second surface together and/or funnel shapes may be formed on either side of the material collection area.

2 Claims, 2 Drawing Sheets

(56) References Cited

U.S. PATENT DOCUMENTS

| | | | | |
|---|---|---|---|---|
| D327,345 | S * | 6/1992 | Lammon et al. | D34/1 |
| 5,147,102 | A | 9/1992 | Dyer, Jr. | |
| 5,326,175 | A | 7/1994 | Carter | |
| 5,364,188 | A | 11/1994 | Godfried et al. | |
| RE34,849 | E | 2/1995 | Sanders | |
| 5,524,423 | A | 6/1996 | Haley | |
| 5,660,402 | A * | 8/1997 | Jones | B65F 1/1468 280/19 |
| 5,709,477 | A | 1/1998 | Schinasi et al. | |
| 5,722,220 | A | 3/1998 | Greenland | |
| 5,943,831 | A | 8/1999 | Pangburn | |
| 6,267,504 | B1 | 7/2001 | Screen | |
| D469,609 | S * | 2/2003 | Hoffman | D3/301 |
| 6,565,101 | B2 | 5/2003 | Jones, Jr. et al. | |
| 6,758,596 | B2 | 7/2004 | McDonough | |
| 7,093,867 | B2 | 8/2006 | Yardley et al. | |
| 7,367,600 | B1 | 5/2008 | Lew et al. | |
| D578,598 | S * | 10/2008 | Anderson | D22/108 |
| 7,520,546 | B2 | 4/2009 | Monahan | |
| 7,552,956 | B1 | 6/2009 | Holloway | |
| 7,594,754 | B2 | 9/2009 | Costello | |
| D611,670 | S | 3/2010 | Booth | |
| 8,075,185 | B2 * | 12/2011 | Hecht et al. | 383/16 |
| 8,544,922 | B1 * | 10/2013 | Huzar | 294/214 |
| 2004/0212201 | A1 | 10/2004 | Esposito | |
| 2007/0177826 | A1 | 8/2007 | Schoenig et al. | |
| 2010/0008601 | A1 | 1/2010 | Prudencio | |

OTHER PUBLICATIONS

EZ Leaf Hauler, Item Model No. 007, printed Mar. 8, 2010, web pages from Amazon.com, 5 pages.

Leaf Net, Item Model No. L88, printed Mar. 8, 2010, web pages from Amazon.com, 4 pages.

Leaf & Lawn Reaper, printed Mar. 8, 2010, www.leafreaper.com, 2 pages.

Vern Nelson, "Carry On Make a garden tarp to ease heavy tasks", The Oregonian, Jun. 17, 2010, 1 page.

Tuff Mate Products, "Tuff Mate Tarps", printed Mar. 8, 2010, www.tuffmatetarps.com, 2 pages.

US Receiving Office, "International Search Report", Apr. 9, 2012, 2 pages.

US Receiving Office, "Written Opinion of the International Searching Authority", Apr. 9, 2012, 5 pages.

* cited by examiner

MATERIAL COLLECTION APPARATUS

CROSS-REFERENCE TO RELATED APPLICATIONS

This application claims priority to U.S. Provisional Patent Application Ser. No. 61/415,742, filed Nov. 19, 2010 and entitled DEBRIS COLLECTING DEVICE, the disclosure of which is herein incorporated by reference.

BACKGROUND

The present disclosure relates to an apparatus for the collection and/or transportation of material, for example, trash, lawn debris, such as leaves, grass cuttings, weeds, or any other objects that may be collected, for example objects that may be collected by sweeping. Examples of material collection apparatuses are disclosed in U.S. Pat. Nos. 4,580,372; D611,670; 6,267,504; 5,943,831, 5,722,220, 7,552,956; 7,367,600; 7,093,867; 6,758,596; 7,520,546; 4,434,827; 4,561,480, 4,693,504; 5,147,102; 7,367,600, 7,594,754; 4,938,607; Re. 34,849; 7,552,956; 4,561,480 and Publication Nos. 2004/0212201 and US2007/0177826. The complete disclosures of the above patents and/or patent applications are herein incorporated by reference for all purposes.

SUMMARY

In one example, an apparatus for collecting material is provided. The apparatus may include a flexible support structure having a first surface and a second surface, the first surface including a material collection area. The apparatus may further include a closure system including a first fastener member disposed on the first surface and a second fastener member disposed on the second surface. At least a portion of the closure system may be spaced from a peripheral edge of the support structure and/or may be configured to releaseably join the first surface and the second surface together. The support structure may include an open configuration and a rolled configuration, wherein in the rolled configuration the closure system may releaseably join the first surface and the second surface together and/or funnel shapes may be formed on either side of the material collection area.

A further example of an apparatus for collecting material may include a flexible support structure having a material collection area and a carrying system including a first graspable member and a second graspable member. The first graspable member may be disposed on the support structure diagonally opposite the second graspable member such that the material collection area is between the first and second graspable members. The support structure may include an open configuration and a carrying configuration. In the carrying configuration the support structure is supported by the carrying system such that the collected material is substantially concentrated in the material collection area.

A further example of an apparatus for collecting material may include a flexible support structure including a material collection area and a closure system including a first fastener member disposed on the support structure and a second fastener member disposed on the support structure substantially diagonally opposing the first fastener member. The first and second fastener members may be configured to releaseably engage each other. The apparatus may further include a carrying system including a first graspable member disposed on the support structure substantially adjacent the first fastener member and a second graspable member disposed on the support structure substantially adjacent the second fastener member.

Advantages of the present disclosure will be more readily understood after considering the drawings and the Detailed Description.

DETAILED DESCRIPTION OF VARIOUS EMBODIMENTS

Figure 1:
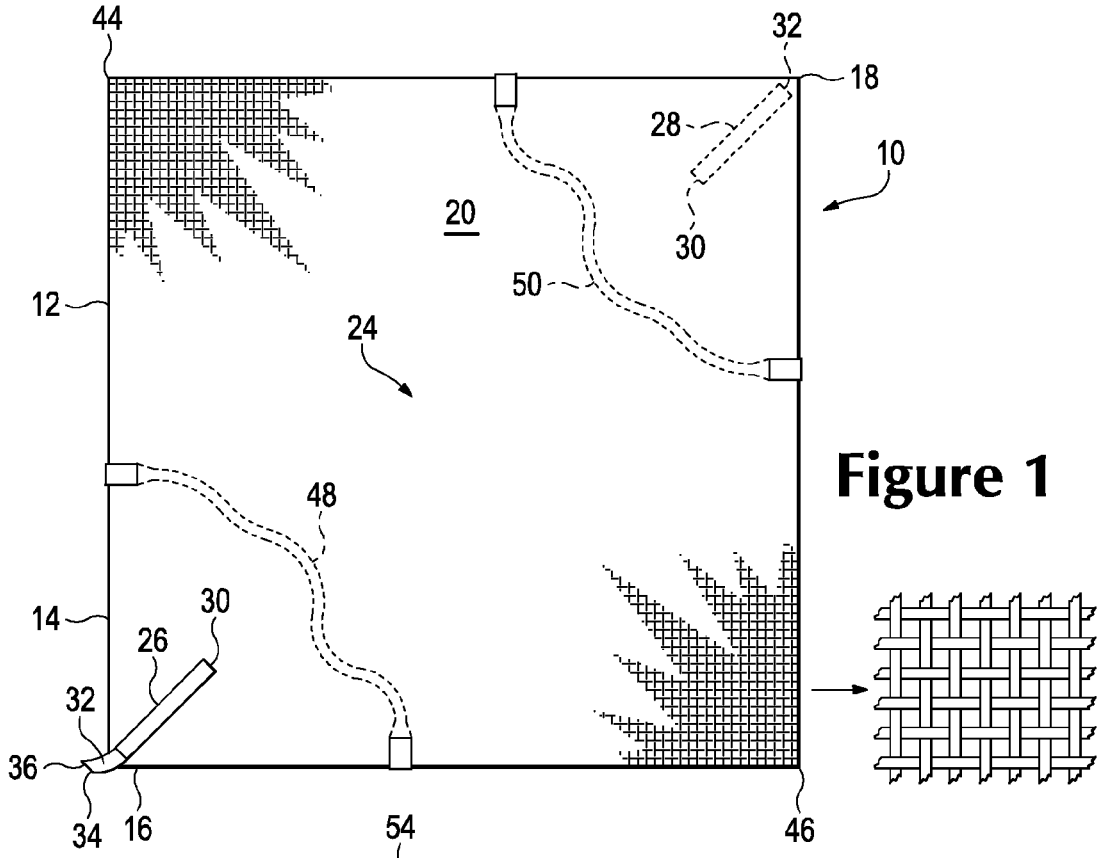
FIG. 1 is a top view of an apparatus for collecting material in accordance with the present disclosure, showing a first surface of a support structure and including an enlarged view of an area of the support structure.

FIGS. 1-4 show various views of an apparatus for collecting material in accordance with the present disclosure, indicated generally at 10. As shown in FIG. 1, apparatus 10 for collecting material in accordance with the present disclosure may function in a substantially open configuration as a collection platform for debris. Apparatus 10 may be arranged into a rolled configuration (FIG. 3) and/or a carrying configuration (FIG. 4) to secure, compact and/or concentrate the debris. Apparatus 10 may further be arranged into the rolled configuration and/or the carrying configuration for lifting and dispensing the debris into a collection container.

Apparatus 10 may include a support structure 12. All or a portion of support structure 12 may include a flexible material. Additionally and/or alternatively, all or a portion of support structure 12 may be substantially water and/or mold resistant. For example, some or all of the strands of a woven material may be coated with a water resistant and/or mold resistant substance.

Additionally and/or alternatively, all or a portion of support structure 12 may include a woven material, for example a woven pre-consumer recycled material. The weave of the material may be open, also referred to as permeable, such that fluid (water and/or air) may pass through support structure 12. An enlarged sectional view of support structure 12 is shown in FIG. 1. The woven strands may allow for breathability, which may prevent mold/rot of material during storage. Non-breathable sheets, such as tarps, may mold or rot if not properly dried before long term storage. The woven strands may further allow water to drain through support structure 12, preventing a puddle of water from accumulating on support structure 12, like what would happen with a tarp.

Support structure 12 may include a quadrangle shape, for example a square or a rectangle. Support structure 12 may include a peripheral edge 14. Support structure 12 may further include, for example, a first corner 16 and a second corner 18 diagonally opposing first corner 16. For example, support structure 12 may include a square shape having a size of four (4) feet by four (4) feet, however other embodiments may have different shapes and/or sizes. Support structure 12 may additionally and/or alternatively include all other shapes known to those skilled in the art, such as circular, elliptical, polyangular, etc.

Figure 2:
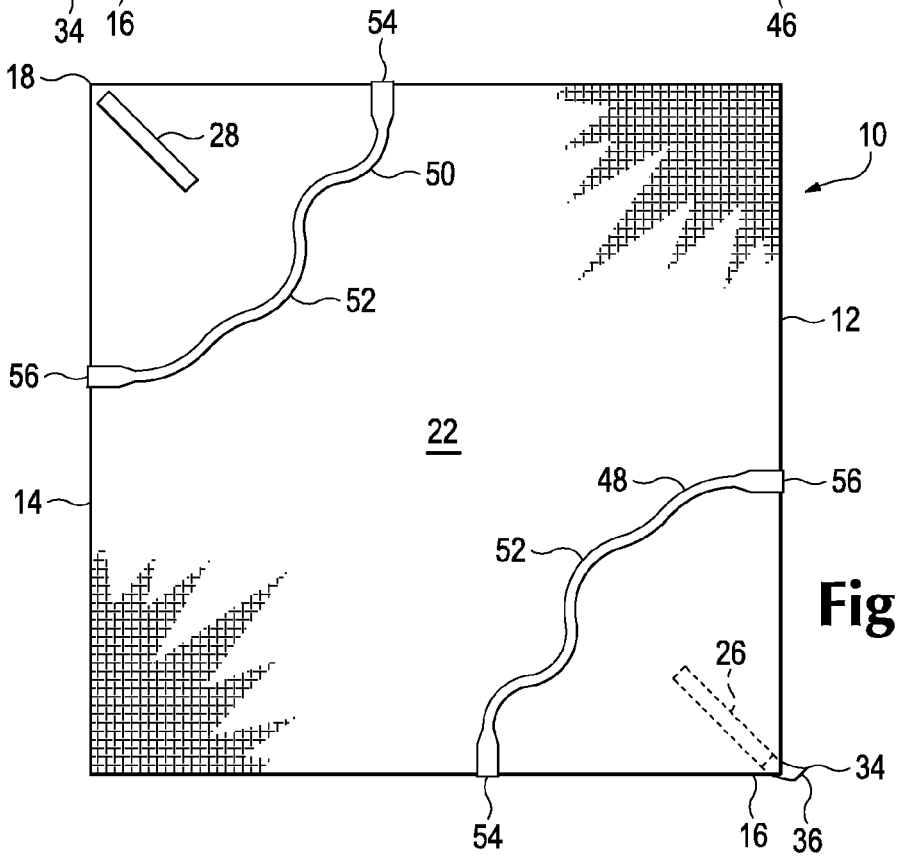
FIG. 2 is a top view of the apparatus for collecting material of FIG. 1, showing a second surface of the support structure

Support structure 12 may include a first surface 20, also referred to as a debris side (FIG. 1), and a second surface 22, also referred to as a carrying side (FIG. 2). First surface 20 may include a material collection area 24. Material collection area 24 may include all or a portion of first surface 20. Material collection area 24 may be substantially centered within the configuration of first surface 20.

Figure 3:
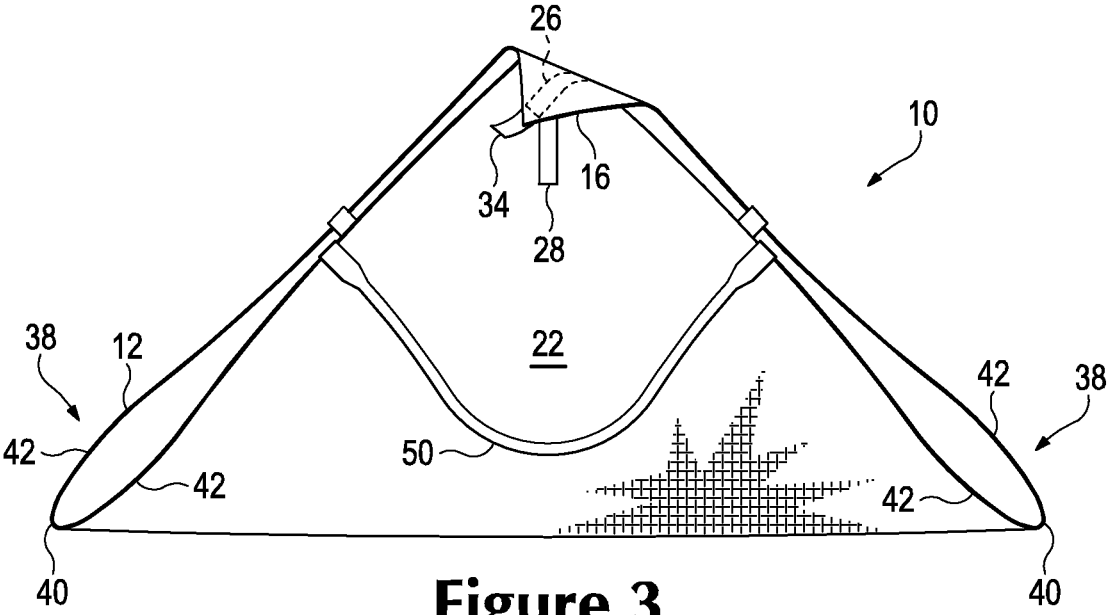
FIG. 3 is a side perspective view of the apparatus for collecting material of FIG. 1, showing the support structure in a rolled configuration.

Additionally and/or alternatively, apparatus 10 may include a closure system including a first fastener member 26 and a second fastener member 28. First and second fastener members 26, 28 may be configured to releaseably engage each other. First fastener member 26 may be disposed on first surface 20 and second fastener member 28 may be disposed on second surface 22. The first and second fastener members may be configured to releaseably join first surface 20 and second surface 22 together (FIG. 3).

First and second fastener members 26, 28 may be disposed on opposite sides, edges and/or corners of support structure 12. Material collection area 24 may be substantially centered between first and second fastener members 26, 28. As shown in FIGS. 1 and 2, first fastener member 26 may be disposed on support structure 12 and second fastener member 28 disposed on support structure 12 substantially diagonally opposing first fastener member 26. In other words, the first and second fastener members may be substantially diagonally disposed across support structure 12. For example, first fastener member 26 may be disposed adjacent first corner 16 and second fastener member 28 may be disposed adjacent a second corner 18.

As shown in FIGS. 1 and 2, at least a portion of the closure system, for example a distal end 30 of one or both of first and second fastener members 26, 28, may be spaced from peripheral edge 14 of support structure 12. In some embodiments, the closure system may span between the portion spaced from peripheral edge 14 to substantially adjacent peripheral edge 14. For example, one or both of first and second fastener members may span extend between distal end 30 and an adjacent end 32, substantially adjacent to peripheral edge 14. The closure system may include a hook and loop fastener system, such as Velcro®, snaps, hook and eye and/or any other closure means known to those skilled in the art.

In some embodiments, second fastener member 28 may be spaced from the tip of second corner 18 on second surface 22 of support structure 12, for example by two inches. Second fastener member 86 may include a strip of Velcro® material approximately 7.5 inches long and 1 inch wide. First fastener member 26 may be spaced from the tip of first corner 16 on first surface 20 of support structure 12, for example by one inch. First fastener member 26 may include a strip of Velcro® material approximately 7 inches long and 1 inch wide.

First fastener member 26 and/or first corner 16 may include a tab member 34 configured to aid in removing attachment of first fastener member 26 from second fastener member 28 and/or first corner from second corner. Tab member 34 may be attached at adjacent end 32 of first fastener member 26 and/or first surface 20 of support structure 12 and may include a free end 36. Free end 36 may extend beyond first corner 16. Tab member 34 may be approximately 1.5 inches long and may include a colored vinyl material.

When support structure 12 is disposed with first surface 20 facing upwards (FIG. 1), first corner 16 of support structure 12 may be rolled towards second corner 18 of support structure 12 such that first fastener member 26 engages second fastener member 28 and/or support structure 12 forms a tunnel-like containment space having a funnel 38 at either end (FIG. 3).

As shown in FIG. 3, in the rolled configuration, the closure system may releaseably join first surface 20 and second surface 22 together and/or funnel shapes 38 may be formed on either side of material collection area 24. Funnels 38 may assist in the dispensing of any collected debris from apparatus 10, for example, by assisting in concentrating the material being dispensed such that it is more likely that the dispensed material will fall into the intended area. Funnels 38 may include a bottom portion 40 of periphery 14 extending further than the side portions 42 of the periphery 14. In embodiments of support structure 12 including a quadrangle shape, bottom portion 40 may include a third corner 44 and/or a second corner 46.

Additionally and/or alternatively, apparatus 10 may include a carrying system including a first graspable member 48 and a second graspable member 50. First and second graspable members 48, 50 may be disposed on opposite sides, edges and/or corners of support structure 12. Material collection area 25 may be substantially centered between first and second graspable members 48, 50. Additionally and/or alternatively, one or both either side of the first and second graspable members 48, 50 may be disposed substantially adjacent peripheral edge 14 of support structure 12.

Additionally and/or alternatively, first and second graspable members 48, 50 may each span a portion of second surface 22. Additionally and/or alternatively, first graspable member 48 may span a portion of first corner 16 and second graspable member 50 may span portion of the diagonally opposed second corner 18. First graspable member 48 may be disposed on support structure 12 substantially adjacent first fastener member 26. Second graspable member 50 may be disposed on support structure 12 substantially adjacent second fastener member 28. First graspable member 48 may span a portion of second surface 22 substantially adjacent to first fastener member 26 and second graspable member 50 may span a portion of second surface 22 substantially adjacent to second fastener member 28.

One or both of first and second graspable members 48, 50 may include a strap 52. The length of strap 52 may be greater than the distance of support structure 12 spanned by first or second graspable member 48, 50. A first end 54 and/or a second end 56 of strap 52 may be attached to support structure 12 substantially adjacent periphery 14 such that first graspable member 48 spans a portion of first corner 16 and second graspable member 50 spans a portion of second corner 18. Strap 52 may include a resilient material and/or may include padding.

Figure 4:
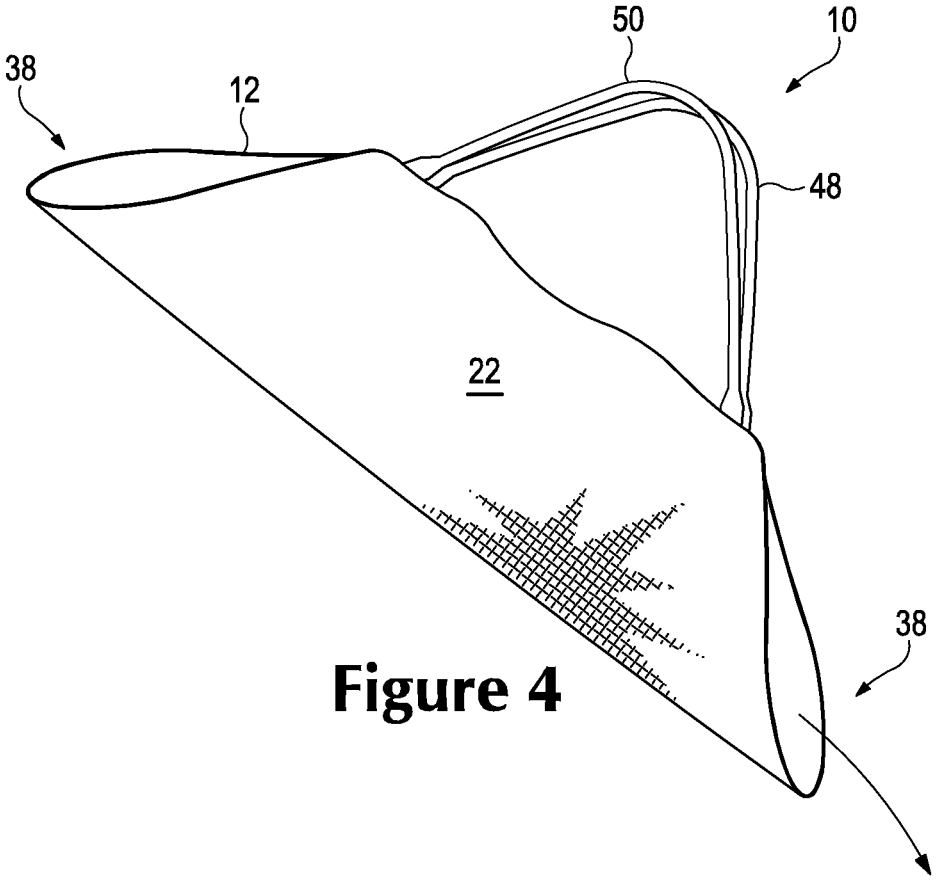
FIG. 4 is a side perspective view of the apparatus for collecting material of FIG. 1, showing the support structure in a carrying configuration.

As shown in FIG. 4, apparatus for collecting material 10 may further include the carrying configuration position in which support structure 12 may be supported by the carrying system. Additionally and/or alternatively, in the carrying configuration, the collected material may be substantially concentrated in material collection area 24. Additionally and/or alternatively, in the carrying configuration, funnels 38 may be formed on either side of material collection area 24.

In operation, support structure 12 may be unrolled and/or laid in the open configuration. Preferably, support structure 12 is laid flat on a support surface, such as a lawn containing an abundance of leaves, however, support structure 12 need not be perfectly horizontal, but should be at least partially oriented such that gravity will not force materials placed upon support structure 12 to move from support structure 12.

Second surface 22 may be facing the support surface and/or first surface 20 may be facing away from the support surface (FIG. 1).

A user may rake leaves or other debris onto support structure 12 until the material collection are is full and/or a desired fill level is obtained. First corner 16 may be pulled across support structure 12 to the diametrically opposed second corner and/or two corners may be brought together such that first surface 20 of first corner 16 overlaps onto second surface 22 of second corner 18 and/or complementary closure means 26, 28 may be attached to one another (FIG. 3). First and second corners 16, 18 may then be overlapped and/or complementary closure means 26, 28 may be engaged such that apparatus 10 may securely enclose the leaves, or other debris within support structure 12.

A user may then grasp one or both first and second graspable members 48, 50, bring first and second graspable members 48, 50 together and/or lift apparatus 10 (FIG. 6). To carry the collected debris, the user may rest first and second graspable members 48, 50 on the user's shoulders. To dispose of the collect debris, the user may tilt apparatus 10 such that one of the two funnels 38 is disposed within a refuse container (FIG. 5). A user may then shake out the debris or un-do complementary closure means to cause the collected debris to fall into a refuse container (not shown).

The foregoing description discusses the removal of leaves from a lawn, however, apparatus 10 for collecting material may be for bagging anything suitable for a bag. For example, the disclosed device could be used to dispose of weeds from a garden, or cuttings from an individual's lawn. Additionally, it could be used to dispose of any trash which is more easily swept to a specific location than being picked up, piece-by-piece and placed within a bag as it is picked up.

Some embodiments of the all-in-one apparatus may include a woven sheet, a fastener system, such as Velcro™ fasteners, for securing a set of diagonal corners of the sheet, handles or shoulder straps coupled to diagonal corners of the tarp, and indicator tabs for indicating which corners of the sheet to fasten together.

The various embodiments of the illustrated apparatus for collecting material, and the various components, if present, may be fabricated from any suitable material, or combination of materials, such as plastic, foamed plastic, wood, cardboard, pressed paper, metal, or the like. A suitable material may be selected to provide a desirable combination of weight, strength, durability, flexibility, cost, manufacturability, appearance, safety, and the like.

The exemplary embodiments and methods illustrated and disclosed herein are believed to encompass multiple distinct inventions with independent utility. While each has been disclosed in an exemplary form, the specific embodiments thereof as disclosed and illustrated herein are not to be considered in a limiting sense, as numerous variations of the concepts and components are possible. The subject matter of the inventions includes all novel and non-obvious combinations and subcombinations of the various elements, features, functions and/or properties disclosed herein.

Where any description recites "a" or "a first" element or the equivalent thereof, such description should be understood to include incorporation of one or more such elements, neither requiring nor excluding two or more such elements.

I claim:

1. An apparatus for collecting debris material capable of having mold grow in it, the apparatus comprising;

a flexible support structure having a top surface and a bottom surface, the support structure including top and bottom surfaces being formed of a woven material coated substantially with a mold-resistant substance and a water-resistant substance, the woven material being constructed with a weave that is open sufficiently to allow water to pass through, and the top surface including a material collection area;

a carrying system including a first graspable member and a second graspable member, the first graspable member disposed on the support structure substantially diagonally opposite the second graspable member such that the material collection area is between the first and second graspable members;

the support structure including an open configuration and a carrying configuration, wherein in the carrying configuration the support structure is supported by the carrying system such that the collected material is substantially concentrated in the material collection area;

wherein the first graspable member spans a portion of a first corner of the support structure and the second graspable member spans a portion of a diagonally opposed second corner of the support structure;

a closure system including a first fastener member disposed adjacent the first corner and a second fastener member disposed adjacent the second corner;

wherein the first fastener member is disposed on the top surface of the support structure and the second fastener member is disposed on the bottom surface of the support structure, wherein the closure system releaseably joins the top surface and the bottom surface together such that funnel shapes are formed on either side of the material collection area to allow for dispensing of collected debris material;

wherein the permeable support structure is constructed to be effective to minimize the possibility of mold growing within it as a result of contact with the collected debris material; and wherein the mold-resistant and water-resistant qualities of top and bottom surfaces of the support structure are effective to minimize the possibility of mold growing within the support structure as a result of contact with the collected debris material.

2. The apparatus of claim 1, wherein the woven material is made from pre-cut recycled materials that have mold-resistant and water-resistant qualities.

* * * * *